US012721429B1

(12) United States Patent
Huang

(10) Patent No.: US 12,721,429 B1
(45) Date of Patent: Sep. 1, 2026

(54) FOLDABLE CABINET

(71) Applicant: Sai Huang, Taizhou (CN)

(72) Inventor: Sai Huang, Taizhou (CN)

( * ) Notice: Subject to any disclaimer, the term of this patent is extended or adjusted under 35 U.S.C. 154(b) by 0 days.

(21) Appl. No.: 18/972,750

(22) Filed: Dec. 6, 2024

(51) Int. Cl.
*A47B 47/00* (2006.01)

(52) U.S. Cl.
CPC ..... *A47B 47/00* (2013.01); *A47B 2220/0072* (2013.01)

(58) Field of Classification Search
CPC ..... A47B 47/00; A47B 47/04; A47B 47/042; A47B 2220/0072; A47B 43/00
USPC .... 312/257.1, 263, 258, 108, 107, 111, 262, 312/265.5, 211, 212, 292; 292/120, 218
See application file for complete search history.

(56) References Cited

U.S. PATENT DOCUMENTS 2,072,383 A * 3/1937 Rottman ..... A47B 47/04 292/120
3,583,781 A * 6/1971 Yamawaki ..... A47B 3/00 312/258
4,579,401 A * 4/1986 Mears ..... A47B 43/00 312/258
6,113,203 A * 9/2000 Chen ..... B25H 3/00 312/258
6,179,399 B1 * 1/2001 Brustle ..... A47B 88/95 312/348.4
6,814,244 B1 * 11/2004 Hathcock ..... E05D 15/502 49/193
8,661,862 B2 * 3/2014 Mikolajczyk ..... E05B 63/14 70/79
9,655,441 B2 * 5/2017 Chuang ..... A47B 88/90
2005/0225220 A1 * 10/2005 Huang ..... A47B 88/956 312/348.4
2007/0145870 A1 * 6/2007 Uffner ..... A47B 47/042 312/257.1
2013/0127316 A1 * 5/2013 Wu ..... A47B 88/9416 312/258

FOREIGN PATENT DOCUMENTS

CN 210300103 U * 4/2020
CN 112056821 A * 12/2020
CN 117837885 A * 4/2024 ..... A47B 43/00
WO WO-7901164 A * 12/1979 ..... B65D 45/16

* cited by examiner

*Primary Examiner* — Janet M Wilkens

(57) ABSTRACT

A foldable cabinet, comprising a bottom panel, a side panel and a back panel, wherein the side panel on one side is hinged with a front frame that can be opened and closed, and the other end of the front frame is plugged with the side panel on the other side and is provided with a first locking structure that is locked with the side panel on this side; the back panel comprises a first back panel and a second back panel, the first back panel is hinged with the side panel on one side, the second back panel is hinged with the side panel on the other side, and the first back panel and the second back panel are hinged with each other.

5 Claims, 4 Drawing Sheets

FOLDABLE CABINET

FIELD OF THE INVENTION

The present application relates to household products. More specifically, the present application relates to foldable cabinet.

BACKGROUND

When decorating their homes, people often encounter narrow spaces that cannot accommodate regular furniture, leading to wasted potential. To address this issue, the gap cabinet was created. This type of storage cabinet features a slim design specifically intended for placement in these tight areas, allowing homeowners to maximize their storage options.

Gap cabinets currently available require significant space for storage, resulting in increased costs and reduced economic benefits in warehousing and logistics.

SUMMARY

The present application provides a foldable cabinet to at least solve the technical problem in the prior art that the gap cabinet occupies a large space after being stored.

To achieve the purpose mentioned above, the present application provides a folding cabinet, including a bottom panel, a side panel, and a back panel, wherein the side panel on one side is hinged with a front frame that can be opened and closed, and the other end of the front frame is plugged into and cooperates with the side panel on the other side and is provided with a first locking structure that cooperates and locks with the side panel on this side; the back panel includes a first rear panel and a second rear panel, the first rear panel is hinged with the side panel on one side, the second rear panel is hinged with the side panel on the other side, and the first rear panel and the second rear panel are hinged to each other; the bottom panel is hinged with the side panel on one side and abuts against the side panel on the other side so that the bottom panel can only be flipped toward the inside of the folding cabinet.

In some embodiments, the first locking structure includes a first locking structure disposed on the front frame and a first locking portion disposed on the side panel and cooperating with the first locking structure to lock the front frame.

In some embodiments, the first locking structure is hinged to the side of the front frame and is located inside the folding cabinet, and the first locking portion is located inside the side panel.

In some embodiments, the first locking portion is provided relative to the side panel protrusion, and the first locking structure is provided with a clamping portion extending toward the first locking portion at one end close to the first locking portion, and the clamping portion is engaged with the first locking portion.

In some embodiments, the first locking structures are distributed longitudinally on the side of the front frame, and at least two of them are provided.

In some embodiments, the side edge of the front frame is provided with a hinge portion distributed in the longitudinal direction and protruding toward the side panel, and the front frame is hinged to the side panel through the hinge portion.

In some embodiments, the folding cabinet is provided with a cover panel at the upper end, the side panels, the rear panel and the front frame are respectively provided with plug-in portion that cooperate with the cover panel, and the side panels are respectively provided with second locking structures that cooperate with the cover panel to lock.

In some embodiments, the second locking structure includes a second locking member disposed at the upper end of the side panel and a Second locking structure disposed on the cover panel and locked in cooperation with the second locking member.

In some embodiments, the lower end of the side panel is provided with the Second locking structure which cooperates and locks with the second locking structure of another folding cabinet when stacking.

In some embodiments, a detachable panel is horizontally arranged inside the folding cabinet, and the side panel and/or the rear panel are provided with abutment portions for placing the panel.

The beneficial effects of this application are as follows:

1. The rear and bottom panels of the folding cabinet can be folded inward, allowing the front frame, which is hinged to the side panel, to flip over to the other side panel once the rear and bottom panels are folded. This design enables further folding and storage, effectively saving space and reducing logistics costs.
2. A first locking mechanism is located on the side of the front frame opposite the hinge with the side panel. This mechanism can be secured with the other side panel, enhancing the stability of the folding cabinet when it is in the unfolded position.

BRIEF DESCRIPTION OF THE DRAWINGS

The technology may be more completely understood in connection with the following drawings, in which.

Figure 1:
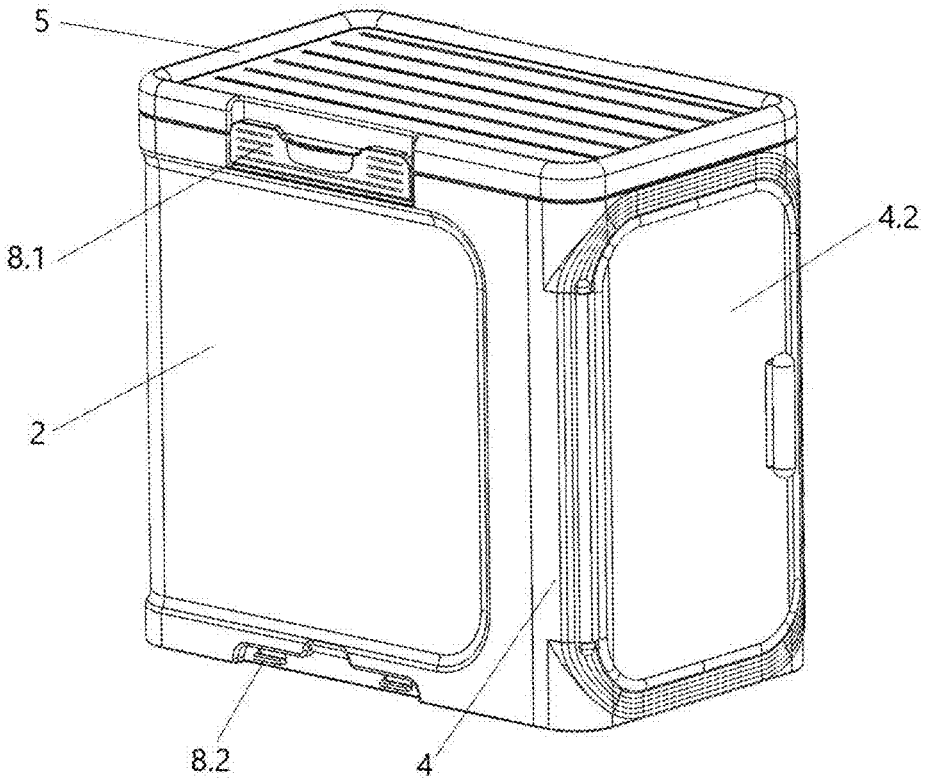
FIG. 1 is a perspective view of a foldable cabinet, according to an embodiment.
Figure 2:
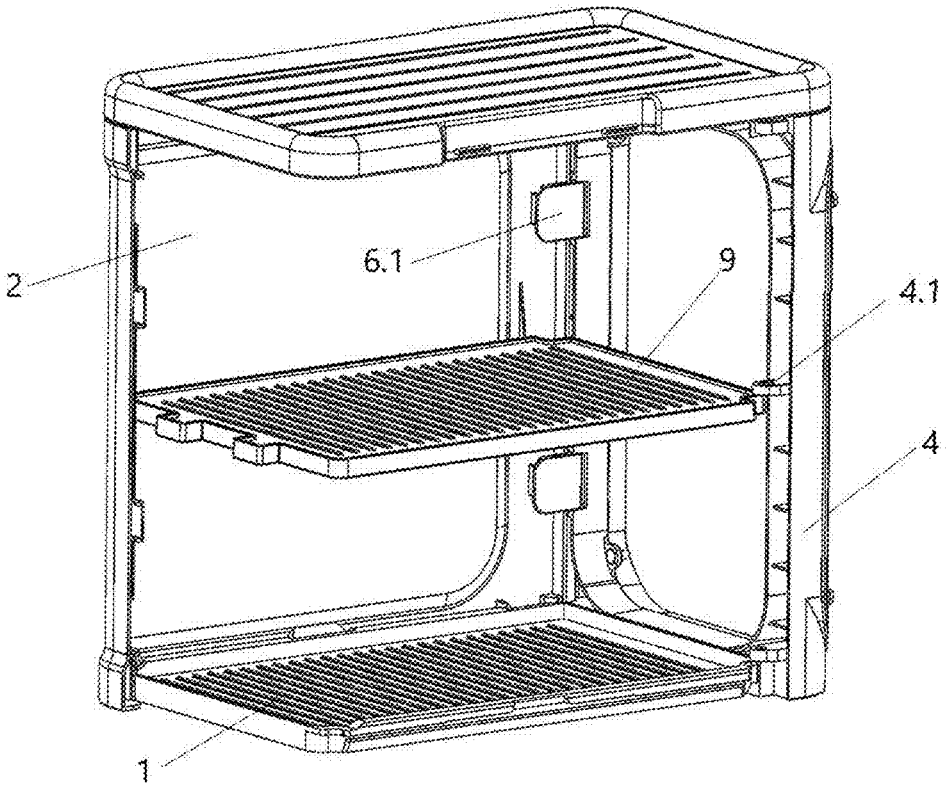
FIG. 2 is an internal structure of a foldable cabinet, according to an embodiment.
Figure 3:
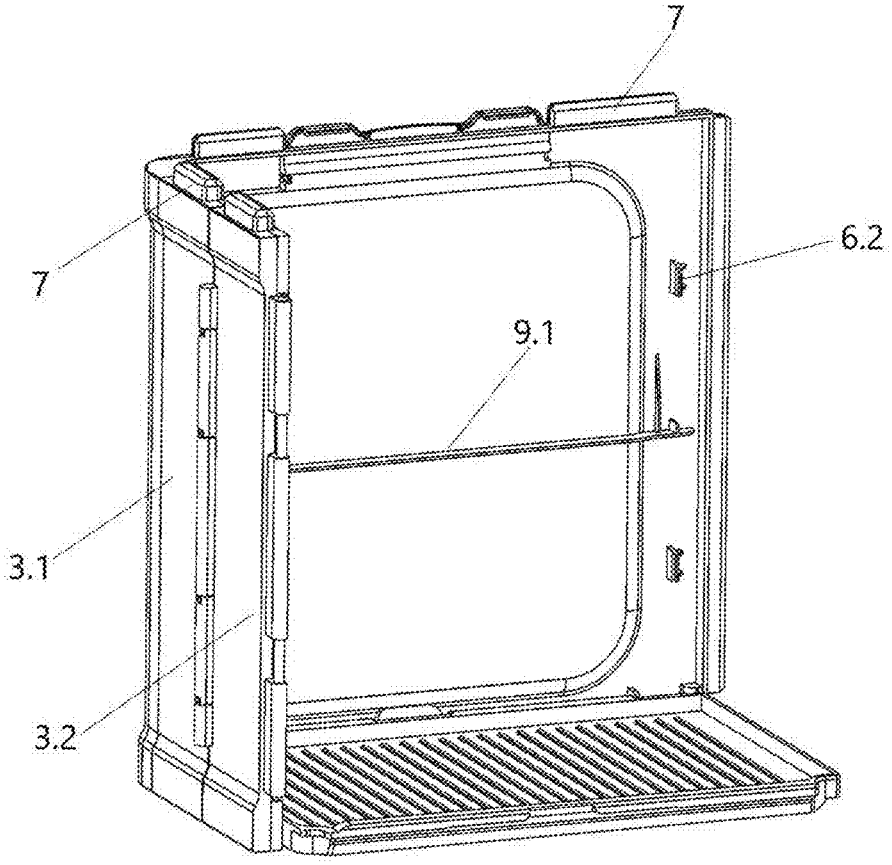
FIG. 3 is another internal structure of a foldable cabinet, according to an embodiment.
Figure 4:
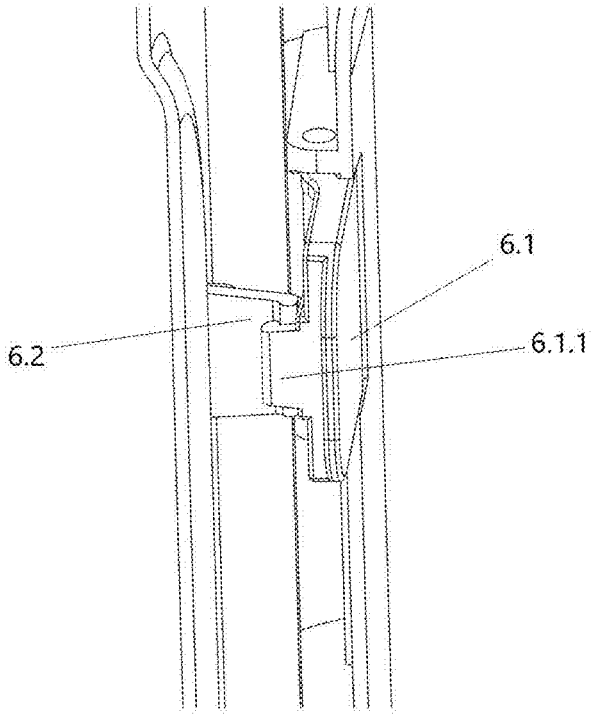
FIG. 4 a schematic diagram of the cooperation between the first locking structure and the first locking portion of the embodiment of the present application.

As show in FIG. 1-4

1. bottom panel;
2. side panel;
3.1 first rear panel;
3.2 second rear panel;
4. front frame;
4.1 hinged portion;
4.2 cabinet door;
5. cover panel;
6.1. first locking structure;
6.1.1. clipping portion;
6.2 first locking portion;
7. plug-in portion;
8.1 second locking member;
8.2 Second locking structure;
9. panel panel;
9.1 abutment portion While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION OF EMBODIMENTS

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

The present application provides a folding cabinet, comprising a bottom panel, side panels and a back panel, wherein the side panel on one side is hingedly connected to a front frame that can be opened and closed, and the other end of the front frame is plugged with the other side panel and is provided with a first locking structure that is locked with the side panel; the back panel comprises a first rear panel and a second rear panel, the first rear panel is hingedly connected to the side panel on one side, the second rear panel is hingedly connected to the side panel on the other side, and the first rear panel and the second rear panel are hingedly connected to each other; the bottom panel is hingedly connected to the side panel on one side and abuts against the side panel on the other side, so that the bottom panel can only be flipped toward the inside of the folding cabinet As shown in FIG. 1-4, a folding cabinet, comprising a bottom panel 1, side panels 2, a back panel, a front frame 4 and a cover panel 5. The back panel includes a first rear panel 3.1 and a second rear panel 3.2, the first rear panel 3.1 is hinged to the side panel 2 on one side, the second rear panel 3.2 is hinged to the side panel 2 on the other side, the first rear panel 3.1 and the second rear panel 3.2 are hinged to each other, and the back panel can only be folded and stored toward the inside of the folding cabinet. The bottom panel 1 is hinged to the side panel 2 on one side and abuts against the side panel 2 on the other side, so that the bottom panel 1 can only be flipped and stored toward the inside of the folding cabinet.

Additionally, one end of the front frame 4 is hinged to one of the side panels 2, allowing the front frame 4 to be opened and closed relative to the folding cabinet. The other end of the front frame 4 fits securely into the other side panel 2 and features a first locking mechanism that works in conjunction with the side panel 2 to secure it. This first locking mechanism consists of a first locking structure 6.1, which is hinged to the side of the front frame 4 and positioned near the inside of the folding cabinet. It also includes a first locking portion 6.2 located on the inner side of the side panel 2, which aligns with the first locking structure 6.1 to lock the front frame 4 in place. The front frame 4 can be locked or unlocked simply by flipping the first locking structure 6.1.

The first locking portion 6.2 features a protrusion that aligns with the side panel 2. The first locking structure 6.1 includes a clipping section 6.1.1 that extends towards the first locking portion 6.2 at one end, which is situated close to it. The clipping section 6.1.1 engages with the first locking portion 6.2. In this design, the first locking structures 6.1 are arranged longitudinally on the side of the front frame 4, with at least two members provided. In this specific embodiment, there are two locking members.

Wherein, the side of the front frame 4 is equipped with Hinged portions 4.1 that connect with the side panels 2. These Hinged portions 4.1 are positioned along the length of the frame and extend outward toward the side panels 2. In this design, there are at least three Hinged portions 4.1 arranged along the longitudinal direction, with three being utilized in this particular embodiment.

Wherein, the front frame 4 is hinged with a cabinet door 4.2 that can be opened and closed.

Wherein, the upper ends of the side panels 2, the rear panel and the front frame 4 are respectively provided with plug-in portion 7 that cooperate with the cover panel 5. The cover panel 5 is covered on the upper end of the folding cabinet, and the plug-in portion 7 are inserted into the inner part of the cover panel 5.

Wherein, the left and right side panels 2 are respectively provided with a second locking structure that cooperates with the cover panel 5 to lock. The second locking structure includes a second locking member 8.1 hinged on the upper end of the side panel 2 and a second locking portion 8.2 provided on the cover panel 5 and locked with the second locking structure 8.1. The cover panel 5 can be locked and unlocked by flipping the second locking structure 8.1.

Wherein, the lower end of the side plate 2 is also provided with a second locking portion 8.2, which can be used to lock with the second locking structure 8.1 of another folding cabinet when the folding cabinets are stacked.

Furthermore, a detachable panel 9 is horizontally arranged inside the folding cabinet, and abutment portions 9.1 for placing the panel 9 are arranged on the side of the side panel 2 and the rear panel close to the inside of the folding cabinet.

To fold and store the partition panel 9, first remove it from the folding cabinet. Next, unlock the second locking structure 8.1 and the second locking portion 8.2, then take off the cover plate 5 from the folding cabinet. After that, unlock the first locking structure 6.1 and the first locking portion 6.2. Fold the rear plate and the bottom panel 1 inward toward the inside of the folding cabinet. Finally, hinge the front frame 4 with the side panel 2 and rotate it towards the other side panel 2, which has already been folded and stored.

What is claimed is:

1. A foldable cabinet, comprising a bottom panel, side panels, and a back panel, is characterized in that: the side panel on one side is hinged with a front frame that can be opened and closed, and the other end of the front frame is plugged with the side panel on the other side and is provided with a first locking structure that is locked with the side panel on this side; the back panel comprises a first back panel and a second back panel, the first back panel is hinged with the side panel on one side, the second back panel is hinged with the side panel on the other side, and the first back panel and the second back panel are hinged with each other; the bottom panel is hinged with the side panel on one side and abuts against the side panel on the other side so that the bottom panel can only be flipped toward the inside of the folding cabinet;

wherein, a first locking structure arranged on the front frame and a first locking portion arranged on the side panel and cooperating with the first locking structure to lock the front frame;

wherein the first locking structure is hinged to the side of the front frame and is located inside the folding cabinet, and the first locking portion is located inside the side panel.

2. The foldable cabinet of claim 1, wherein the first locking portion is provided with a protrusion relative to the side panel, and the first locking structure is provided with a clamping portion extending toward the first locking portion at one end close to the first locking portion, and the clamping portion is engaged with the first locking portion.

3. The foldable cabinet of claim 1, wherein the side edge of the front frame is provided with a hinge portion distributed in the longitudinal direction and protruding toward the side panel, and the front frame is hingedly connected to the side panel through the hinge portion.

4. The foldable cabinet of claim 1, wherein the upper end of the folding cabinet is provided with a cover panel, the side panels, the rear panel and the front frame are respectively provided with plug-in parts that cooperate with the cover panel, and the side panels are respectively provided with second locking structures that cooperate with the cover panel to lock.

5. The foldable cabinet of claim 1, wherein a detachable partition is horizontally arranged inside the folding cabinet, and the side panels and the rear panel are provided with abutment portions for placing the partition.

* * * * *